United States Patent [19]

Shull et al.

[11] Patent Number: 4,464,865

[45] Date of Patent: Aug. 14, 1984

[54] PORTABLE HERMETIC COMPRESSOR CUTTING MACHINE

[76] Inventors: Jessie J. Shull, 2823 W. Chicago, Springfield, Mo. 65803; Jimmy J. Hunt, 1204 Eva, Pasadena, Tex. 77502

[21] Appl. No.: 355,862

[22] Filed: Mar. 8, 1982

[51] Int. Cl.[3] ..... B24B 5/08

[52] U.S. Cl. ..... 51/105 R; 51/217 T; 51/99

[58] Field of Search ..... 51/99, 105 R, 216 T, 51/217 T, 237 R; 269/47, 71, 76; 82/46, 78, 86, 100, 101; 248/163 R, 165, 168

[56] References Cited

U.S. PATENT DOCUMENTS

| | | | |
|---|---|---|---|
| 2,386,266 | 10/1945 | Robertson | 248/163.1 |
| 2,775,852 | 1/1957 | Lowitz | 51/217 T X |
| 3,313,505 | 4/1967 | Petrie | 248/165 |

*Primary Examiner*—Frederick R. Schmidt
*Assistant Examiner*—Judy J. Hartman
*Attorney, Agent, or Firm*—Harvey B. Jacobson

[57] ABSTRACT

Base structure is provided defining a predetermined workpiece center axis and workpiece support structure is rotatably supported from the base for rotation about the center axis. The workpiece support structure includes positioning structure for adjustable shifting of the support structure along the center axis and mounting structure for support of a compressor housing therefrom with the center axis of a cylindrical portion of the housing substantially coinciding with the first mentioned center axis. A mount portion is carried by the base and is laterally spaced from the first mentioned axis. A cutting wheel assembly including a rotary power driven cutting wheel is provided and a support arm swingably supports the cutting wheel assembly from the mount portion for oscillatory swinging movement relative thereto about an axis paralleling the first mentioned axis and with the axis of rotation of the cutting wheel also paralleling the first mentioned axis and swingable toward and away from the latter.

4 Claims, 6 Drawing Figures

PORTABLE HERMETIC COMPRESSOR CUTTING MACHINE

BACKGROUND OF THE INVENTION

Hermetic refrigeration compressors are desirable when other than high refrigeration loads are to be experiences due to the reliability of hermetic compressors and the reduced incidents of refrigerant fluid leakage associated therewith. However, when hermetic wear out or need internal repairs, they are conventionally discarded and replaced by new hermetic compressors due to the fact that no structure heretofore has been provided for efficiently cutting into the housing of a hermetic compressor in a manner such that the housing may be readily subsequently resealed after repairs have been made. Accordingly, a need exists for a structure and method whereby a hermetic compressor housing may be cut into in a manner to enable repairs to be made to the compressor and which also allows the compressor housing to be subsequently resealed.

Various forms of devices for opening hermetically sealed casings and other structures, including some of the general structural and operational features of the instant invention, are disclosed in U.S. Pat. Nos. 1,340,409 2,142,710, 2,587,952, 2,775,852, 2,836,016 and 4,053,287.

BRIEF DESCRIPTION OF THE INVENTION

The hermetic compressor cutting machine of the instant invention is constructed in a manner whereby the cylindrical portion of a hermetic compressor housing may be readily cut along the original sealing weld thereof to enable separation of the housing halves, repair of the internal compressor components and subsequent resealing of the housing by electric welding of the separated housing halves together. The cutting machine includes a rotary grinding head which is used to perform the housing cutting operation and the rotary grinding head is capable of forming the desired smooth cut in separating the housing halves.

Further, the rotary grinding head is swingably mounted for movement toward and away from the periphery of a cylindrical housing portion to be cut and the cutting machine includes structure for rotatably supporting the cylindrical housing portion mounted thereon about its longitudinal center axis and also for adjustable shifting along the axis of rotation of the housing portion, whereby controlled cutting of the housing portion to be severed may be effected and the positioning of the circumferential cut on the housing by the rotary cutting head may be precisely adjusted longitudinally of the housing.

The main object of this invention is to provide a cutting machine which may be utilized to cut a hermetic compressor housing along a circumferential zone of a cylindrical portion thereof in a manner whereby repairs may be made to the internal components of the hermetic compressor and the separated housing components may be subsequently resealed by electric welding.

Yet another object of this invention is to provide a cutting machine which will be capable of rotatably supporting the cylindrical portion of a hermetic compressor housing for rotation about its center axis and for adjustable positioning along the axis of rotation thereof relative to a rotary cutter head.

A further object of this invention, in accordance with the immediately preceding object is to provide a rotary cutter head swingably supported from the machine for movement toward and away from the axis of rotation of a cylindrical housing portion supported from the cutting machine.

Yet another very important object of this invention is to provide a cutting machine which will be adapted to support and slowly turn various different sizes and types of hermetic compressor housings, so that they are rotated about an axis substantially coinciding with the center axis of the cylindrical portion of the housing.

A final object of this invention to be specifically enumerated herein is to provide a cutting machine in accordance with the preceding objects and which will conform to conventional forms of manufacture, be of simple construction and easy to use, so as to provide a device that will be ecomically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
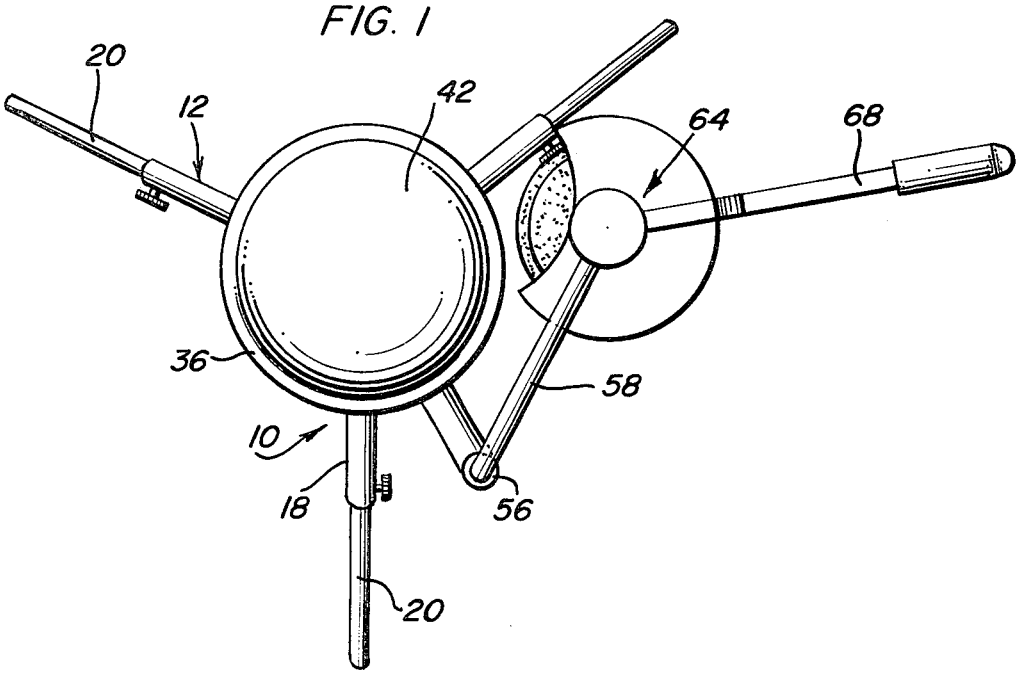
FIG. 1 is a top plan view of the cutting machine of the instant invention with the rotary cutter head thereof shown as swingable toward and away from the cylindrical housing portion of a hermetic compressor rotatably supported from the cutting machine.
Figure 2:
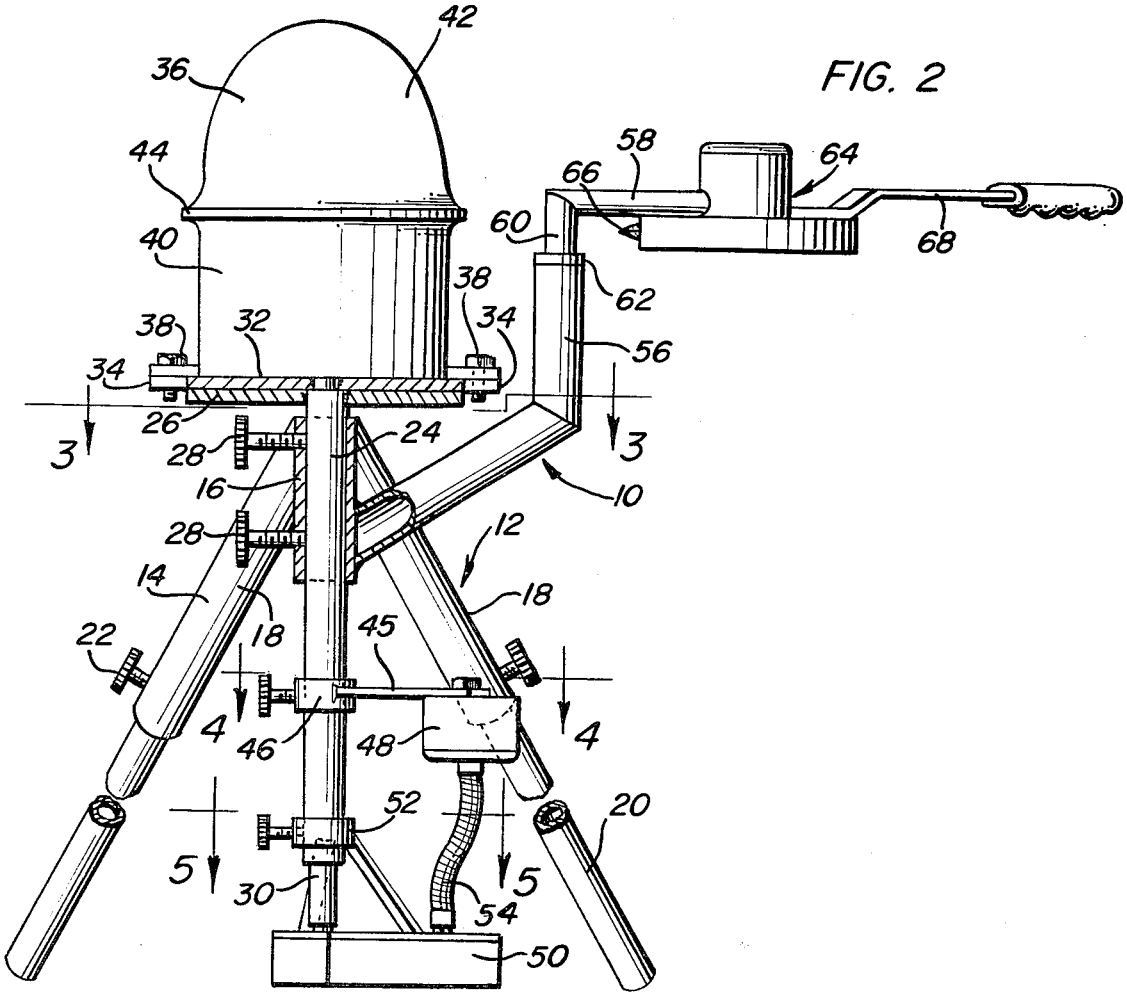
FIG. 2 is a front elevational view of the assemblage illustrated in FIG. 1 with parts thereof being broken away and illustrated in vertical section and with the rotary cutting head shifted away from the cylindrical housing portion to be cut thereby.
Figure 5:
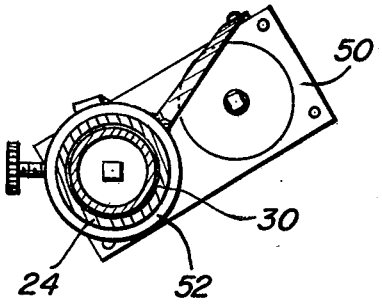
FIG. 5 is an enlarged horizontal sectional view taken substantially upon the plane indicated by the section line 5—5 of FIG. 2.
Figure 3:
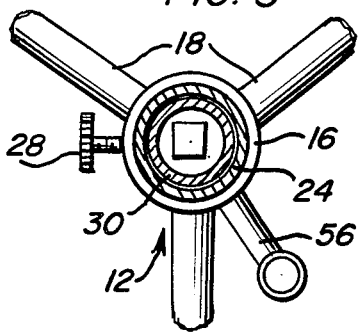
FIG. 3 is an enlarged horizontal sectional view taken substantially upon the plane indicated by the section line 3—3 of FIG. 2.
Figure 4:
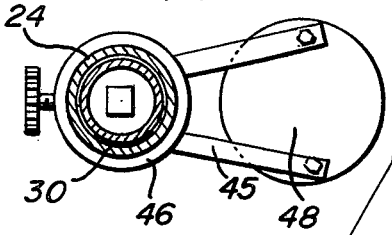
FIG. 4 is an enlarged horizontal sectional view taken substantially upon the plane indicated by the section line 4—4 of FIG. 2.
Figure 6:
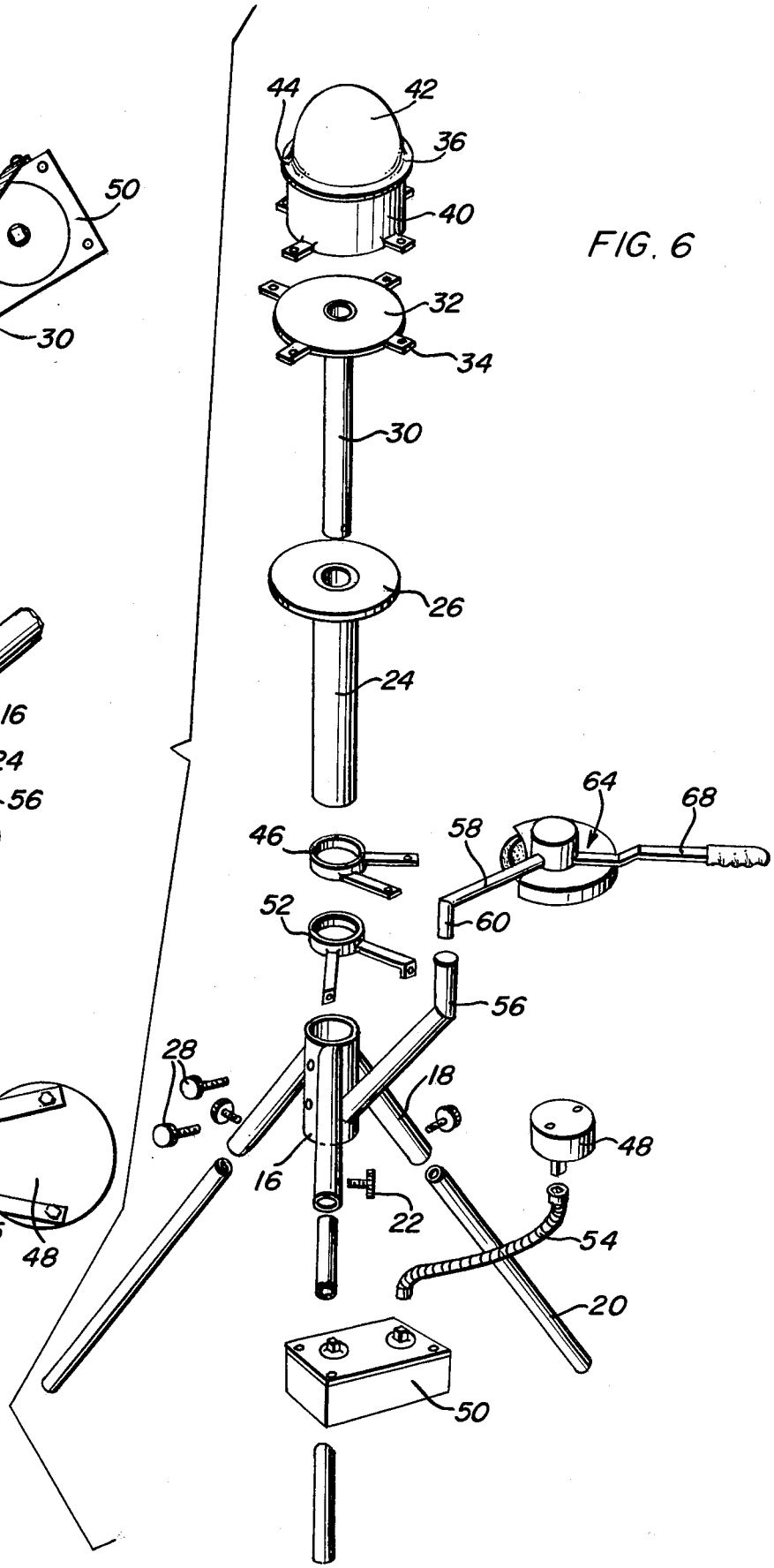
FIG. 6 is an exploded perspective view of the cutting machine.

Referring now more specifically to the drawings, the numeral 10 generally designates the cutting machine of the instant invention. The machine 10 includes a base assembly referred to in general by the reference numeral 12 and consisting of three downwardly divergent legs 14 equally spaced about and secured to a central sleeve 16. The legs 14 include tubular upper end portions 18 into which lower smaller diameter lower end portions 20 are slidingly telescoped, the upper end portions 18 including set screws 22 for engagement with the lower end portions 20 to maintain the latter in adjusted extended positions relative to the upper end portions.

The sleeve 16 has a support sleeve 24 slidingly and rotatably received therethrough and the support sleeve 24 has a horizontal support plate 26 supported from its upper end portion. The outer or mounting sleeve 16 includes a pair of threaded set screws 28 for threaded engagement with the support sleeve 24 whereby the adjusted elevation and angular positioning of the latter relative to the sleeve 16 may be releasably maintained.

A drive shaft 30 is slidably and rotatably received through the support sleeve 24 and includes a mounting plate 32 on its upper end which overlies and is slidably engaged with the upper surface of the support plate 26. The mounting plate 32 includes mounting ears 34 supported therefrom by which a hermetic compressor housing 36 may be mounted on the mounting plate 32 through the utilization of suitable fastening means 38. It is to be noted that the compressor housing includes a cylindrical portion 40 upon the upper end of which a closing dome portion 42 is mounted by electrical welding 44.

A motor support bracket 45 including a set screw equipped mounting sleeve portion 46 is slidably and rotatably adjustably mounted on the support sleeve 24 below the sleeve 16 and supports a motor 48 from an outer portion thereof. A gear reduction assembly 50 is supported from the lower end of the sleeve 24 through the utilization of a set screw equipped sleeve 5 and a flexible drive shaft 54 drivingly connects the output shaft of the motor 48 to the input shaft of the gear reduction assembly 50. The output shaft of the gear reduction assembly 50 is drivingly connected to the drive shaft 30.

The sleeve 16 supports a laterally offset mount 56 therefrom spaced to one side of the support plate 26 and the mount 56 comprises an upstanding sleeve which substantially parallel the sleeve 16. A support arm 58 has one downturned end portion 60 thereof rotatably received within the mount defining sleeve 56 and includes an annular abutment 62 defining a thrust washer. The other end of the support arm supports an electric motor driven rotary grinding wheel assembly referred to in general by the reference numeral 64 including a grinding wheel 66 journaled for rotation about an axis paralleling the sleeve 16. The assembly 64 includes an outwardly projecting handle 68 and may be utilized to swing the end of the arm 58 from which the assembly 64 is supported toward and away from the axis of rotation of the drive shaft 30, whereby the outer periphery of the grinding wheel 66 may be brought into cutting engagement with the electrical welding 44 of the compressor housing 36. Of course, the electric motor 48 is operated to effect slow turning of the drive shaft 30 and thus slow turning of the housing 36. The height of the sleeve 24 is adjusted according to the height of the electric weld relative to the plane in which the grinding wheel 66 is swingable and the dome portion 42 of the housing 36 may therefore be readily cut from the cylindrical portion 40 of the housing 36 in order to expose the internal components of the compressor for repair. After repairs have been effected, the dome portion 42 may be resecured, by welding, to the cylindrical portion 40 by electric welding and the compressor may be placed back in service.

The adjustable lower end portions of the legs 20 insure that the base assembly 12 may be utilized when supported from an uneven surface and the adjustability of the sleeve 24 relative to the sleeve 16 insures that the elevation of the electrical welding 44 to be cut by the rotary grinding wheel 66 may be horizontally registered with the latter. Further, because the motor 48 and gear reduction assembly 50 are removably supported on the lower end of the sleeve 24, these components may be readily removed for storage or shipment. Also, the lower leg portions 20 may be collapsed upwardly into the upper end portions 18 of the legs 14.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An apparatus for cutting the welding joint extending about a cylinderical hermetically sealed compressor housing wherein the welding forms the hermetic seal thereof and for opening the housing for compressor repairs, said apparatus including a portable base assembly for support from a suitable support surface and incorporating an upright base sleeve, an upright support sleeve telescopingly received through and vertically adjustable relative to said base sleeve, a drive shaft slidingly and rotatably received through said support sleeve and including upper end support structure for support of a compressor housing therefrom with a cylindrical portion of said housing substantially aligned with the center axis of said drive shaft, said drive shaft and support sleeve including coacting thrust bearing means to limit downward shifting of said drive shaft relative to said support sleeve, a mount portion carried by said base laterally spaced from said base, a cutting wheel assembly including a rotary power driven cutting wheel, a support arm swingably supporting said cutting wheel assembly from said mount portion for oscillatory swinging movement relative thereto about an upstanding axis spaced laterally from and generally paralleling said base sleeve, with the axis of rotation of said wheel spaced laterally from and generally paralleling the axis of oscillation of said support arm and for swinging movement of said cutting wheel axis toward and away from said center axis, drive means operative to rotatably drive said drive shaft relative to said support sleeve about said center axis at slow rotational speed, said drive means including a drive motor supported from the lower end of said support sleeve below said base sleeve and for vertical adjustment with said support sleeve relative to said base sleeve, said drive motor including a rotary output shaft releasably drivingly connected to the lower end of said drive shaft.

2. The apparatus of claim 1 wherein said base assembly includes a plurality of downwardly divergent support legs spaced about and mounted from said base sleeve.

3. The apparatus of claim 1 wherein said support sleeve includes an upper end horizontal support plate mounted therefrom and upwardly through the center of which the upper end of said support sleeve opens, said support structure comprising a second horizontal support plate mounted from an upper portion of said drive shaft, said coacting thrust bearing means including opposing surfaces of said support plates relatively rotatively engaged with each other.

4. The assembly of claim 1 wherein said base sleeve includes set screw means threadedly supported therefrom and projecting into the interior of said base sleeve and engaged with said support sleeve for releasably retaining the latter in adjusted vertically shifted position relative to said base sleeve.

* * * * *